United States Patent [19]

Adams

[11] Patent Number: 5,058,208

[45] Date of Patent: Oct. 22, 1991

[54] GARMENT HAVING SEAMLESS BODY

[75] Inventor: Marvin Adams, Sylva, N.C.

[73] Assignee: Meltzer Industries Corporation, New York, N.Y.

[21] Appl. No.: 534,168

[22] Filed: Jun. 6, 1990

Related U.S. Application Data

[62] Division of Ser. No. 339,529, Apr. 18, 1989, Pat. No. 4,956,879.

[51] Int. Cl.[5] ..... A41D 11/00

[52] U.S. Cl. ..... 2/80; 2/83; 2/695; 2/79; 2/227; 2/243 R

[58] Field of Search ..... 2/80, 83, 69.5, 79, 2/192, 227, 71, 72, 75, 73, 243 R, 243 B, 2.1 R; 112/265.2

[56] References Cited

U.S. PATENT DOCUMENTS

| | | | |
|---|---|---|---|
| 1,125,467 | 1/1915 | Cannon | 2/80 |
| 1,888,676 | 11/1932 | Jennings | 2/227 |
| 2,615,165 | 10/1952 | Steedman | 2/80 |
| 2,663,873 | 12/1953 | Stern | 2/79 |
| 2,697,837 | 12/1954 | Goldman | 2/79 |
| 3,032,774 | 5/1962 | Wade | 2/192 |
| 3,555,567 | 1/1971 | Owen | 2/80 |
| 4,257,127 | 3/1981 | Kaupin et al. | 2/80 |
| 4,464,795 | 8/1984 | Long et al. | 2/2.1 R |
| 4,843,648 | 7/1989 | Goldberg | 2/80 |
| 4,853,977 | 8/1989 | Foreman | 2/79 |
| 4,862,517 | 9/1989 | Meistrell | 2/2.1 R |

FOREIGN PATENT DOCUMENTS

| | | | |
|---|---|---|---|
| 778998 | 2/1968 | Canada | 2/80 |
| 212103 | 3/1924 | United Kingdom | 2/80 |

*Primary Examiner*—Werner H. Schroeder
*Assistant Examiner*—Gloria Hale
*Attorney, Agent, or Firm*—Samuel J. Stoll

[57] ABSTRACT

A garment, such as a child's sleeper, having a body portion made of sheet material, without seams, and provided with a longitudinal opening and closure means therefor, such as a slide fastener. The longitudinal opening is for putting the garment on a child and taking it off.

The invention also includes a method and means of making such garment.

5 Claims, 5 Drawing Sheets

GARMENT HAVING SEAMLESS BODY

REFERENCE TO RELATED APPLICATIONS AND PATENT

This application is a divisional of copending parent application Ser. No. 07/339,529, filed Apr. 18, 1989, now U.S. Pat. No. 4,956,879, dated Sept. 18, 1990. This application is also related to copending application Ser. No. 07/534,169, filed even date herewith, which is also a divisional of said parent application.

BACKGROUND OF THE INVENTION

1. Field of the Invention

This invention relates to body enclosing garments such as children's sleepers, and especially garments wherein body seams could be a source of discomfort to the wearer.

2. Prior Art

The closest prior art known to applicants consists of the following U.S. patents:

| | |
|---|---|
| 2,743,450 | Kling |
| 3,348,367 | Rush |
| 3,399,642 | Etchison et al |
| 4,272,851 | Goldstein |
| 4,295,230 | Blodgett |
| 4,741,050 | O'Kane et al |
| 4,753,182 | Blackburn |

Additionally, there are the well-known seamless garments made of tubular knit material. The present invention pertains, however, to garments made of sheet material, whether knit or woven, cut to patterns.

Applicants know of no prior art seamless body garments, cut and made of sheet material, or of any prior art means and method of making same.

SUMMARY OF THE INVENTION

The invention consists of a garment of the character described, wherein the body portion is made of a single piece of fabric cut to a desired pattern. Contrary to conventional sewing methods, this piece of fabric is placed behind the sewing machine, it is then drawn to the front of the machine on opposite sides of the needles, then fed to the needles from the front to the back of the machine, through a folder, and finally discharged at the back of the machine. A needle guard is provided on the sewing machine to protect the fabric from the needles as it is drawn from the back to the front of the machine.

For garments requiring slide fastener closures, a slide fastener tape feed is provided at the front of the machine, feeding the slide fastener tape to the fabric at the discharge end of the folder. The folder forms hems in the fabric and needles stitch the hems and slide fastener tape together.

DETAILED DESCRIPTION OF PREFERRED EMBODIMENT OF THE INVENTION

Figures 1, 2:
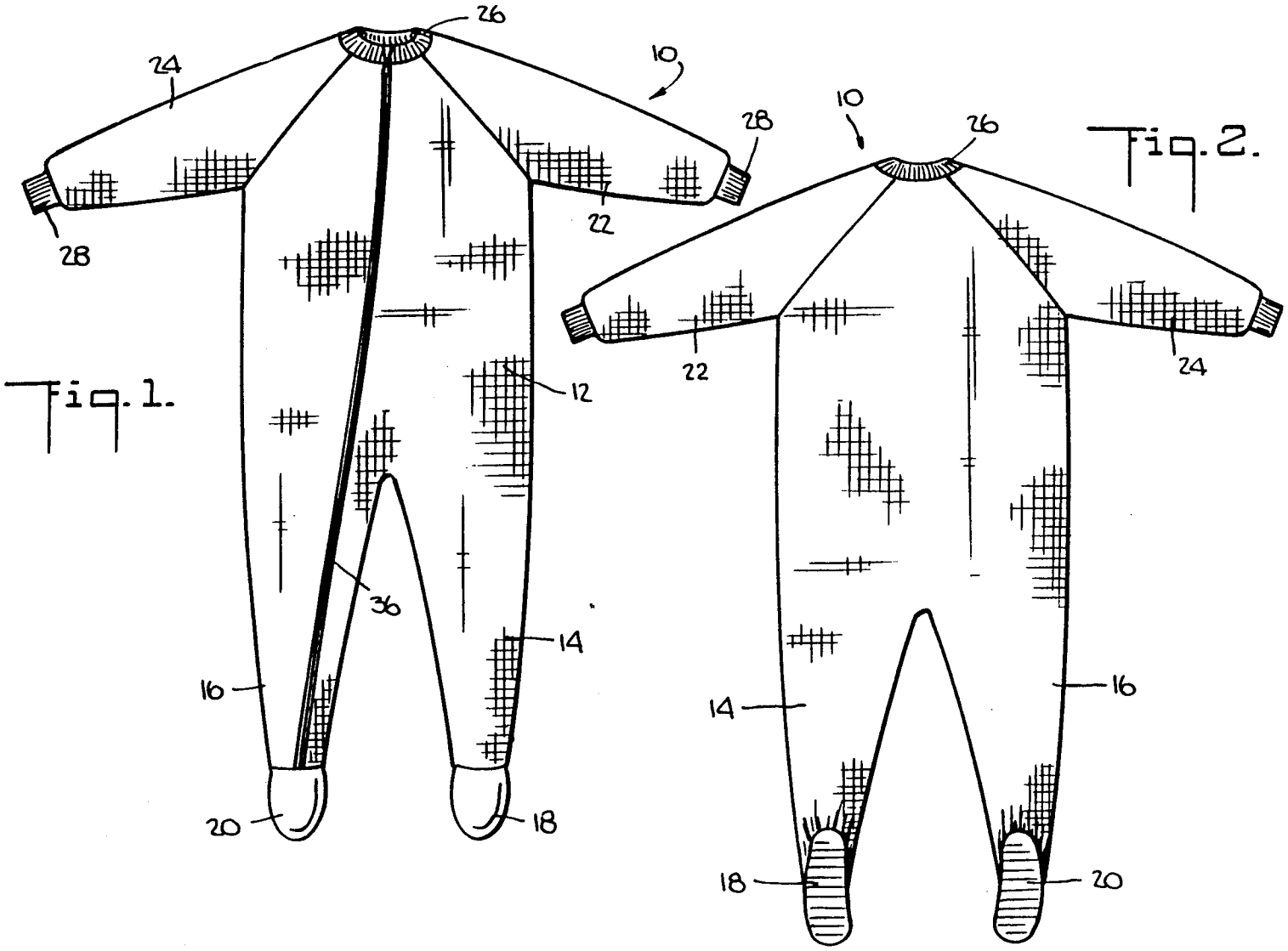
FIG. 1 is a front view of a child's sleeper garment made in accordance with this invention.
FIG. 2 is a back view thereof.

Referring to FIGS. 1 and 2 of the drawing, it will be understood that sleep garment 10 illustrates the garments the present invention covers. Garment 10 comprises a body portion 12 including leg portions 14 and 16 respectively. Foot portions 18 and 20 may be attached to the leg portions if desired.

Sleeves 22 and 24 are sewn to body portion 12, as shown. If desired, collar or neck portion 26 may be attached to the body and sleeve portions, and cuffs 28 may be attached to the sleeve portions.

Figure 3:
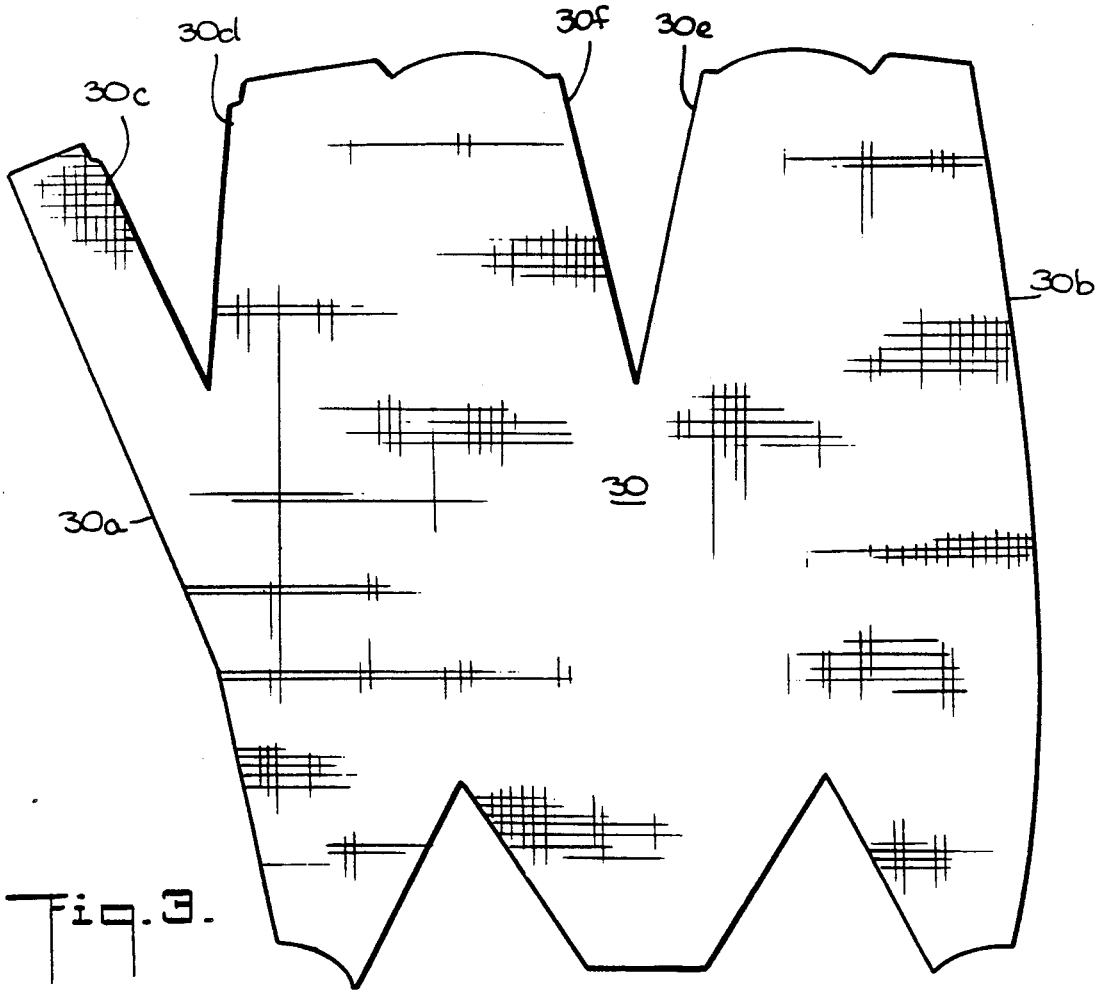
FIG. 3 is a plan view of the body portion, including leg portions, of the garment before the sewing operation.
Figure 4:
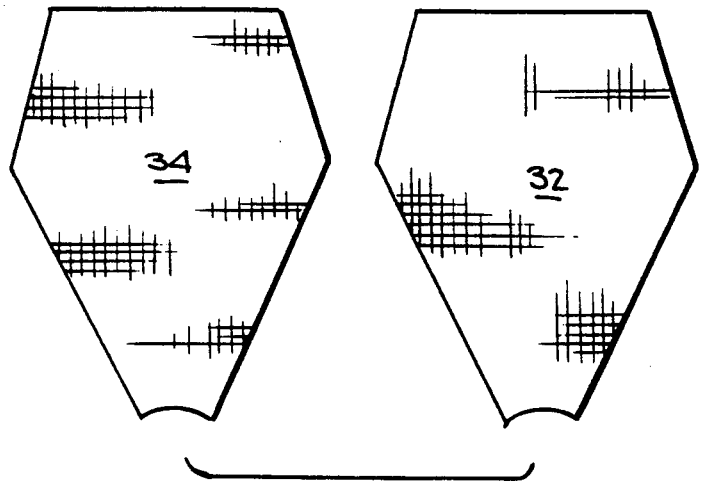
FIG. 4 is a plan view of the arm portions of the garment before they are sewn to the body portion.
Figure 5:
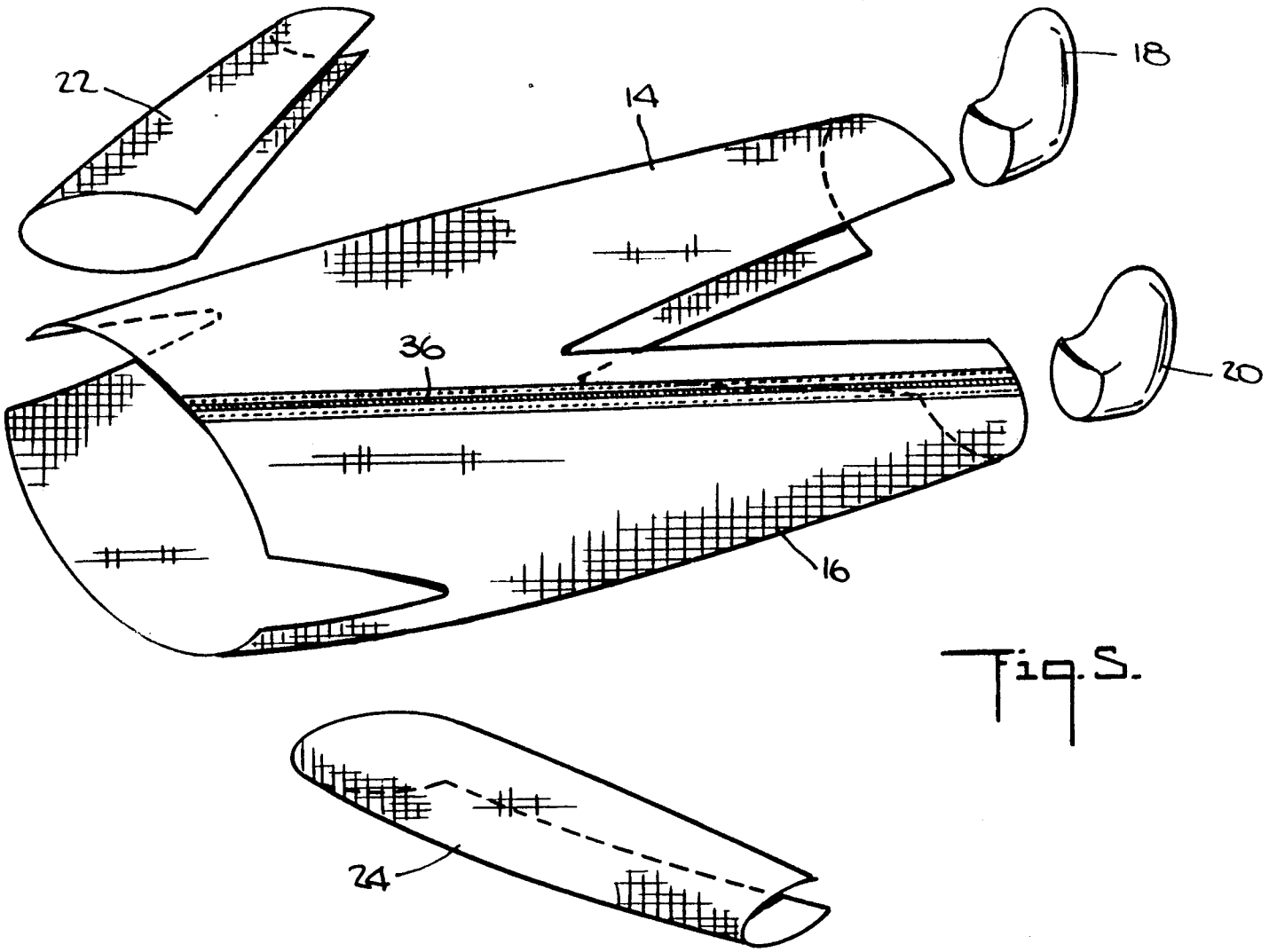
FIG. 5 is an exploded, perspective view showing the three fabric components of the garment and the foot portions.

Turning now to FIGS. 3 and 4, it will be understood that body portion 12 of the garment, including legs 14 and 16, is made of a fabric component 30 that is cut to a pattern of like design. Similarly, sleeves 22 and 24 are made of fabric components 32 and 34 that are cut to a pattern of like design.

Figure 6:
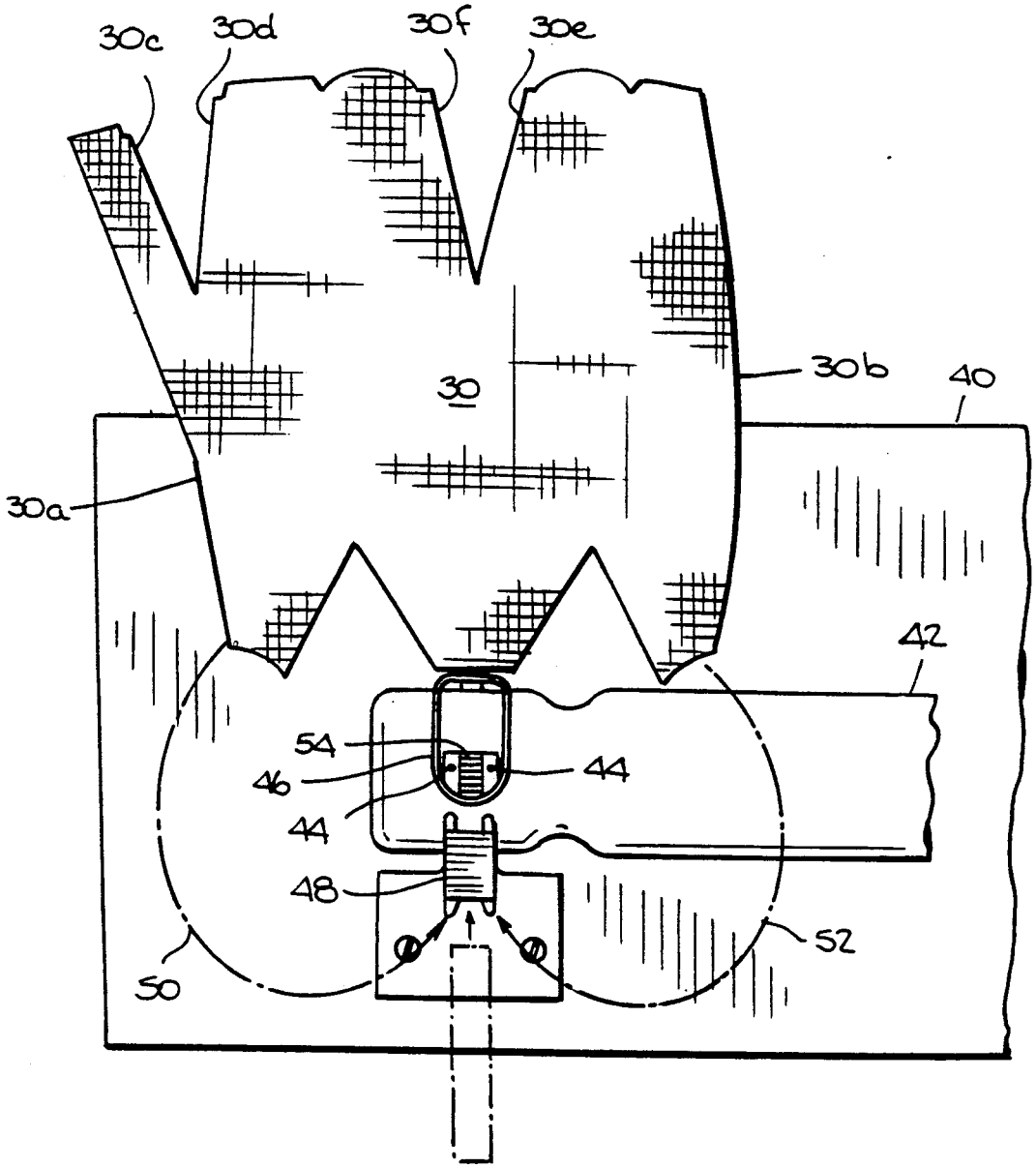
FIG. 6 is a top view of a sewing machine used in the present invention, showing the folder that forms hems in the body portion of the garment and the tape feeder that feeds slide fastener tape to the hems, and further showing the body portion fabric positioned on the sewing machine for the start of the sewing machine for the start of the sewing operation.
Figure 7:
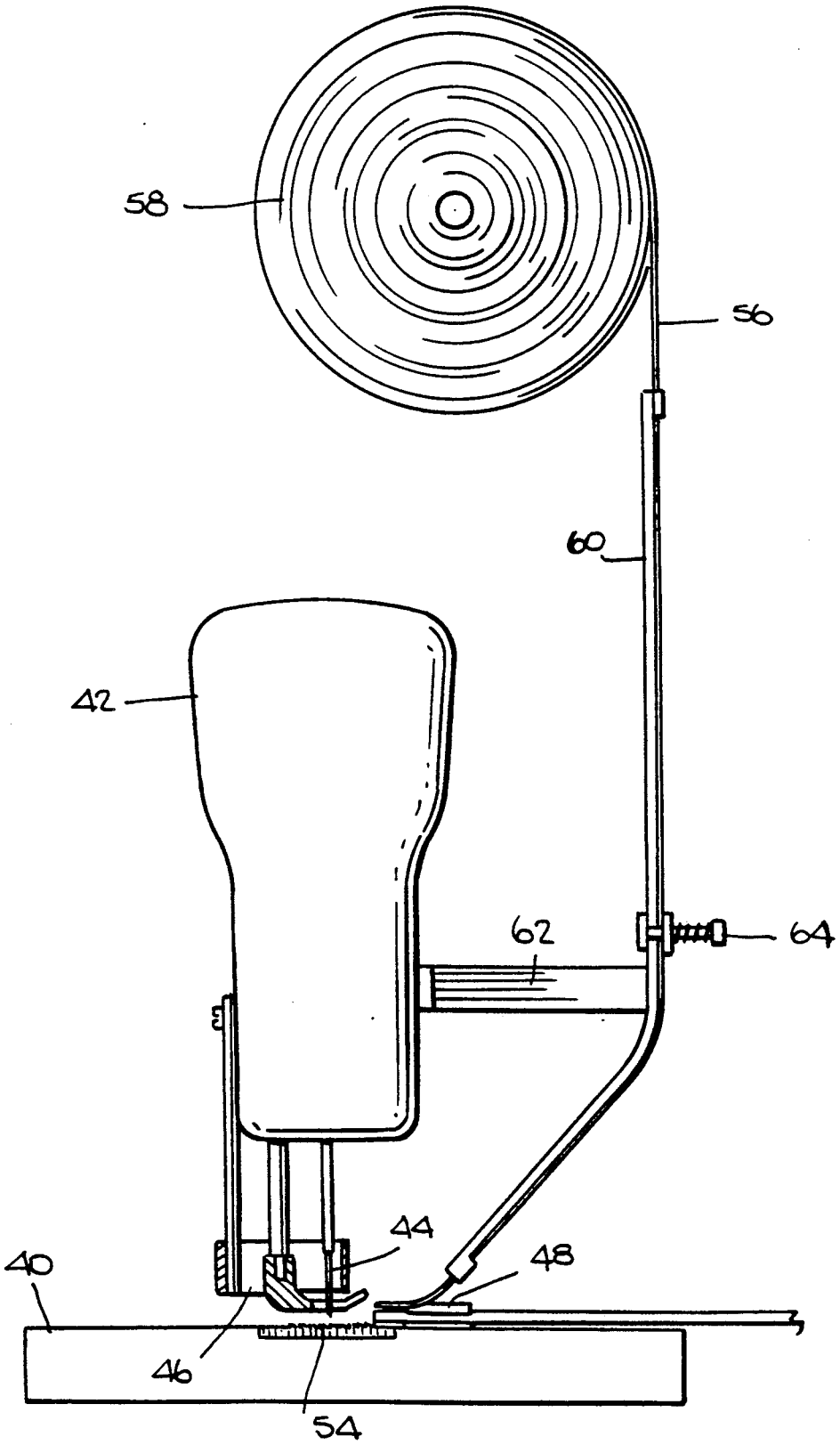
FIG. 7 is a side view of what is shown in FIG. 6.

Body portion 12 is made by sewing fabric component 30 and a slide fastener tape 36 together in the manner shown in FIGS. 6 and 7, thus:

Fabric component 30 is placed face down on the table 40 of sewing machine 42, behind the needles 44 of said sewing machine, the upper end of the fabric component facing the sewing machine operator. In the illustrative form of the invention, the sewing machine is a 212W140 Singer, a flatbed, two-needle, lock stitch machine, but other sewing machines capable of doing the described work may also be used.

Forward of fabric component 30 is a needle guard 46, preferably in the shape of a ring surrounding the needles, and preventing the fabric from tangling with the needles during the sewing operation. Forward of the needles is a folder 48 which is adapted to fold two edges of the fabric to form hems.

Specifically, side edges **30*a* and 30*b* of fabric component 30 are the edges to be hemmed. To do this, the upper ends of these side edges are drawn forwardly around the needle guard 46 and around folder 48, and they are then fed into said folder as indicated by interrupted directional lines 50 and 52 respectively. This is done by drawing the entire lengths of side edges 30*a* and 30*b* around the needle guard and folder in the paths indicated by said interrupted lines. When these side edges emerge from the folder, they are folded over to form hems and these hems are stitched down in conventional manner when the sewing machine feeder 54** moves them through the sewing station.

During this folding and stitching operation, the fabric component 30 remains face down on the sewing machine table except where bunched up behind the needle guard. The needle guard is shaped at the front to allow the fabric access to the needles, and the guard is spaced from the presser plate to allow the sewn fabric to pass to the back of the sewing machine.

Concurrently with feeding the side edges 30*a* and 30*b* to the needles, slide fastener tape 56 (a pair of tape elements with slide fastener elements secured to and between them) is also fed to the needles from roll 58 through guide and tension attachment 60. This attachment is secured to the sewing machine by means of a bracket 62. Tension is adjusted by means of screws 64. Consequently, at the same time the hems of the fabric are stitched down, the slide fastener tape is stitched to the hems, (one tape element to each hem), thereby forming a closure 66 between the opposite side edges 30*a*, 30*b* of the fabric component 30, and closing the body portion of the garment. To open the garment, the slide fastener is opened.

The rest of the garment is finished in conventional manner. Edges 30*c* and 30*e* are sewn together to close the leg portion 16, and edges 30*d* and 30*f* are sewn together to close the leg portion 14. Sleeve portions 32 and 34 are sewn in conventional manner to the upper end of the body portion 30 to form sleeves 22 and 24 of the garment. Cuffs 28 are sewn to the sleeves (if desired), collar 26 is sewn to the top of the body (if desired), and foot portions 18 and 20 are sewn to legs 14 and 16 (if desired).

It will now be seen that the body fabric 30 forms both the body of the garment and the legs. When the slide fastener is opened, an opening is formed in the garment extending lengthwise from the top of the garment down along one of the legs to its foot portion. The length of this opening is, of course, a matter of choice. Also, the lengthwise opening may extend through the body alone or, as described and shown, through both the body and the leg.

It will be understood from the foregoing that the term "seamless" as herein used, applies only to garments having a body portion that is made of a single piece of fabric with no seams to hold the body portion together. The garment may have seams to attach its closure member (slide fastener tape) to the body portion. It may also have seams to close the leg portions and to sew the sleeves to the body portion. And it may also have cuffs sewn to the sleeves, feet sewn to the legs, and a collar sewn to the body and sleeves. But in the area where seams might cause discomfort to the wearer, in the body of the garment, a garment made in accordance with this invention is seamless. This feature is especially valuable when the wearer is an infant or small child.

No method of making this garment is known to applicants except the method herein described. The principal feature of this method resides in placing the body portion behind the sewing machine needles, then drawing the side edges of said body portion forwardly on opposite sides of the needles, and finally folding those side edges backwardly to the needles, together with a slide fastener tape to sew the side edges and the corresponding sides of the tape to each other. At no time does the middle part of the body portion (intermediate its side edges) pass to the front of the machine.

An important feature of the equipment used by this method, is the needle guard (which may take various forms) that prevents the middle part of the body portion from tangling with the needles when the side edges of said body portion are drawn forwardly around the needles to position them for feeding backwardly to the needles. A folder, such as illustrated in the drawing, folds said side edges to form hems when sewn by the needles, and a slide fastener tape guide, with an adjustable tensioning device, feeds said tape to the needles to be sewn to said side edges of the body portion.

These are the important features of the invention, illustrated in principle in the drawing, that are herein claimed.

I claim:

1. A garment, a. having a one-piece body part, b. an opening extending lengthwise of said body part for putting the garment on and taking it off a wearer, and c. a slide fastener secured to said body part along said lengthwise opening for closing and opening said garment, d. said body part including leg portions extending from the body part integrally therewith, e. the lengthwise opening in the body part extending into one leg portion, f. the slide fastener extending into and along the opening in said leg portion and being secured to said leg portion, g. both leg portions having lengthwise extending seams that close them, h. said body part and said leg portions being seamless except for said lengthwise extending seams that close the leg portions.

2. A garment, a. said garment having a one-piece body part, b. an opening extending lengthwise of said body part for putting the garment on and taking it off a wearer, and c. a slide fastener secured to said body part along said lengthwise opening for closing and opening said garment, d. said body part including leg portions extending from the body part integrally therewith, e. the lengthwise opening in the body part extending into one leg portion, f. the slide fastener extending into and along the opening in said leg portion and being secured to said leg portion, g. both leg portions having lengthwise extending seams that close them, h. said body part and said leg portions being seamless except for said lengthwise extending seams that close the leg portions, i. foot portions being provided on the leg portions, non-integrally therewith, j. said foot portions being sewn to said leg portions below said lengthwise extending seams.

3. A garment, a. said garment having a one-piece body part, b. an opening extending lengthwise of said body part for putting the garment on and taking it off a wearer, and c. a slide fastener secured to said body part along said lengthwise opening for closing and opening said garment, d. said body part including leg portions extending from the body part integrally therewith, e. the lengthwise opening in the body part extending into one leg portion, f. the slide fastener extending into and along the opening in said leg portion and being secured to said leg portion, g. both leg portions having lengthwise extending seams that close them, h. said body part and said leg portions being seamless except for said lengthwise extending seams that close the leg portions, i. cutouts for sleeves being formed in the body part, and j. sleeves sewn to said body part at said cutouts.

4. A garment, a. said garment having a one-piece body part, b. an opening extending lengthwise of said body part for putting the garment on and taking it off a wearer, and c. a slide fastener secured to said body part along said lengthwise opening for closing and opening said garment, d. said body part including leg portions extending from the body part integrally therewith, e. the lengthwise opening in the body part extending into one leg portion, f. the slide fastener extending into and along the opening in said leg portion and being secured to said leg portion, g. both leg portions having lengthwise extending seams that close them, h. said body part and said leg portions being seamless except for said lengthwise extending seams that close the leg portions, i. foot portions being provided on the leg portions, non-integrally therewith, j. said foot portions being sewn to said leg portions below said lengthwise extending seams, k. the lengthwise opening extending the full length of the body part and integral leg portion in which it is formed.

5. A garment, a. said garment having a one-piece body part, b. an opening extending lengthwise of said body part for putting the garment on and taking it off a wearer, and c. a slide fastener secured to said body part along said lengthwise opening for closing and opening said garment, d. said body part including leg portions extending from the body part integrally therewith, e. the lengthwise opening in the body part extending into one leg portion, f. the slide fastener extending into and along the opening in said leg portion and being secured to said leg portion, g. both leg portions having lengthwise extending seams that close them, h. said body part and said leg portions being seamless except for said lengthwise extending seams that close the leg portions, i. foot portions being provided on the leg portions, non-integrally therewith, j. said foot portions being sewn to said leg portions below said lengthwise extending seams, k. the lengthwise opening extending the full length of the body part and integral leg portion in which it is formed, l. the lengthwise opening being formed in the front of said body part, and m, in the front of the leg portion into which it extends.

* * * * *